US009716942B2

(12) United States Patent
Lippitt et al.

(10) Patent No.: US 9,716,942 B2
(45) Date of Patent: Jul. 25, 2017

(54) MITIGATING EFFECTS OF CAVITY RESONANCE IN SPEAKERS

(71) Applicant: Bose Corporation, Framingham, MA (US)

(72) Inventors: Benjamin Lippitt, Worcester, MA (US); Greg Zastoupil, North Grafton, MA (US)

(73) Assignee: Bose Corporation, Framingham, MA (US)

( * ) Notice: Subject to any disclaimer, the term of this patent is extended or adjusted under 35 U.S.C. 154(b) by 45 days.

(21) Appl. No.: 14/978,939

(22) Filed: Dec. 22, 2015

(65) Prior Publication Data

US 2017/0180848 A1 Jun. 22, 2017

(51) Int. Cl.

| | |
|---|---|
| ***H04R 1/20*** | (2006.01) |
| ***H04R 1/28*** | (2006.01) |
| ***H04R 1/30*** | (2006.01) |
| ***H04R 1/24*** | (2006.01) |
| ***H04R 9/06*** | (2006.01) |

(52) U.S. Cl.

CPC ..... *H04R 1/2888* (2013.01); *H04R 1/24* (2013.01); *H04R 1/288* (2013.01); *H04R 1/30* (2013.01); *H04R 9/06* (2013.01)

(58) Field of Classification Search

CPC ..... H04R 1/2803; H04R 1/025; H04R 9/06; H04R 1/30; H04R 2400/13

USPC ..... 381/150, 337, 339, 340, 345, 386

See application file for complete search history.

(56) References Cited

U.S. PATENT DOCUMENTS

| | | | | |
|---|---|---|---|---|
| 4,344,504 | A | 8/1982 | Howze | |
| 7,134,523 | B2 | 11/2006 | Engebretson | |
| 7,266,211 | B2 | 9/2007 | Ikeuchi | |
| 7,324,654 | B2 | 1/2008 | Opie et al. | |
| 7,324,656 | B2 | 1/2008 | Iwayama et al. | |
| 7,333,626 | B2 | 2/2008 | Opie et al. | |
| 7,596,236 | B2 | 9/2009 | Vincenot | |
| 7,840,024 | B2 | 11/2010 | Iwayama et al. | |
| 8,130,994 | B2 | 3/2012 | Button et al. | |
| 8,181,736 | B2 | 5/2012 | Sterling et al. | |
| 8,418,802 | B2 | 4/2013 | Sterling et al. | |
| 8,672,088 | B2 | 3/2014 | Sterling et al. | |
| 8,827,074 | B2 * | 9/2014 | Law | A45C 11/00 455/575.2 |
| 8,917,896 | B2 | 12/2014 | Ickler et al. | |
| 9,111,521 | B2 | 8/2015 | Blore et al. | |
| 9,118,988 | B2 | 8/2015 | Ickler et al. | |

(Continued)

FOREIGN PATENT DOCUMENTS

| | | |
|---|---|---|
| DE | 1 157 658 | 11/1963 |
| WO | WO 2006/096801 | 9/2006 |

OTHER PUBLICATIONS

International Search Report & Written Opinion; PCT/US2016/064215; Feb. 24, 2017; 13 pages.

(Continued)

*Primary Examiner* — Brian Ensey

(74) *Attorney, Agent, or Firm* — Fish & Richardson P.C.

(57) ABSTRACT

A speaker includes a housing, at least one electro-acoustic driver including a diaphragm, and a cover secured to one or more of the housing and driver. The cover is configured to partially extend over the diaphragm to affect an associated cavity resonance frequency of an air cavity adjacent to the diaphragm.

22 Claims, 11 Drawing Sheets

(56) References Cited

U.S. PATENT DOCUMENTS

| | | | | |
|---|---|---|---|---|
| 2005/0217927 | A1* | 10/2005 | Noselli | G10K 11/20 181/191 |
| 2006/0062402 | A1 | 3/2006 | Heil | |
| 2011/0064247 | A1 | 3/2011 | Ickler et al. | |
| 2011/0069856 | A1 | 3/2011 | Blore et al. | |
| 2012/0213387 | A1* | 8/2012 | Blore | H04R 1/30 381/104 |
| 2015/0000998 | A1 | 1/2015 | McKinnon et al. | |
| 2015/0289037 | A1 | 10/2015 | Kutil | |
| 2016/0073195 | A1 | 3/2016 | Adamson et al. | |

OTHER PUBLICATIONS

International Search Report & Written Opinion; PCT/US2016/065250; Feb. 24, 2017; 12 pages.

* cited by examiner

MITIGATING EFFECTS OF CAVITY RESONANCE IN SPEAKERS

TECHNICAL FIELD

This disclosure generally relates loudspeakers.

BACKGROUND

Audio reproduction systems for large venues may use arrays of modular loudspeakers to produce the level and distribution of sound energy necessary to fill the venue with sound.

SUMMARY

In one aspect, this document features a speaker that includes a housing, at least one electro-acoustic driver including a diaphragm, and a cover secured to one or more of the housing and driver. The cover is configured to partially extend over the diaphragm to affect an associated cavity resonance frequency of an air cavity adjacent to the diaphragm.

In another aspect, this document features an acoustic transducer that includes a driver cone, an electrodynamic driver, and a cover. The driver cone includes a central portion, an annular peripheral portion, and a diaphragm between the central portion and the peripheral portion. The central portion, the annular peripheral portion, and the diaphragm together form a closed end of an air cavity adjacent to the driver cone. The electrodynamic driver is configured to move the driver cone to vary pressure levels within the air cavity in accordance with an electrical signal. The cover is disposed in contact with the annular peripheral portion such that the cover extends over a portion of a plane of the annular peripheral portion to affect an associated cavity resonance frequency of the air cavity.

In another aspect, this document features a speaker that includes a housing enclosed by two sidewalls, a rear wall, a top surface, and a bottom surface. The speaker also includes two or more low-frequency drivers disposed within the housing such that front faces of the low-frequency drivers are substantially parallel to the rear wall of the housing. A cover is disposed over each of the two or more low-frequency drivers such that the cover partially extends over a diaphragm of the corresponding low-frequency driver to affect an associated cavity resonance frequency of an air cavity adjacent to the diaphragm. The speaker further includes one or more high-frequency drivers disposed between the low-frequency drivers and the rear wall of the housing, and a manifold disposed within the housing. The manifold includes multiple acoustic passages for radiating acoustic outputs from the high-frequency drivers out of the housing.

In another aspect, the document features a speaker that includes one or more drivers, and an acoustic horn that includes a first side panel and a second side panel. Edges of the first and second side panels defines an opening for receiving acoustic outputs from one or more drivers. The speaker also includes a manifold disposed between the opening and the one or more drivers, the manifold including a plurality of acoustic passages for connecting the opening to each of the one or more drivers, and an adaptor. The adaptor is disposed between the manifold and the acoustic horn, and includes multiple apertures for the plurality of acoustic passages. The adaptor is configured to conform to a profile of the opening while maintaining a seal between the acoustic horn and the plurality of acoustic passages.

In another aspect, this document features an adaptor for coupling a plurality of drivers to an acoustic horn. The adaptor includes a plurality of mating plates connected in series, and a plurality of movable joints. Each of the plurality of mating plates is configured to couple with a corresponding one of the drivers, and includes an aperture for providing an acoustic pathway between the corresponding one of the compression drivers and the acoustic horn. The mating plates also include one or more sidewalls configured to attach the adaptor to the acoustic horn in a sealing configuration. The plurality of movable joints are each disposed between adjoining mating plates connected in the series, and are configured to facilitate a conformation of the adaptor to an interface curvature between the adaptor and the acoustic horn.

In another aspect, this document features a speaker that includes an acoustic horn, a manifold, and an adaptor. The acoustic horn includes two or more panels arranged in accordance with a target radiation pattern for radiating acoustic waves produced by one or more drivers. The manifold is disposed between the acoustic horn and the one or more drivers, and includes a plurality of acoustic passages for guiding the acoustic waves from the one or more drivers to a diffraction slot. The adaptor is disposed between the diffraction slot and the acoustic horn. The adaptor is configured to conform to a curvature associated with the diffraction slot while maintaining a seal between the acoustic horn and the plurality of acoustic passages.

Implementations of the above aspects can include one or more of the following features.

An extent to which the cover partially extends over the diaphragm can be configured based on a target value of the cavity resonance frequency. The target value of the cavity resonance frequency can be higher than a cut-off frequency associated with a passband for the driver. The extent to which the cover partially extends over the diaphragm can be configured such that voice coil rubbing in the speaker is avoided. The cover can extend over no more than one third of a cross sectional area of an open end of a conical structure formed by the diaphragm. The at least one electro-acoustic driver can be associated with low-frequency components of audio produced by the speaker. The speaker can include an acoustic horn that includes a first side panel and a second side panel. The edges of the first and second side panels can define an opening for receiving acoustic outputs from one or more high-frequency drivers. The opening can be disposed proximate to an inside end of the at least one electro-acoustic driver, the inside end being opposite to an outside end of the at least one acoustic driver. The outside end is closer than the inside end to an exterior sidewall of the housing. The speaker can include a manifold disposed between the opening and the one or more high-frequency drivers. The manifold can include a plurality of acoustic passages for connecting the opening to each of the one or more high-frequency drivers. The opening can have a convex curvature extending outward from the housing. The speaker can include an adaptor disposed between the manifold and the acoustic horn. The adaptor can include a plurality of apertures for the acoustic outputs from the one or more high-frequency drivers to radiate from the plurality of acoustic passages to the acoustic horn. The adaptor can be semi-flexible, and configured to conform to the convex curvature of the opening. The adaptor can include a plurality of bending portions configured to allow the adaptor to conform to the convex curvature of the opening. The cover can extend over no more than one half of a cross sectional area of an open end of a conical structure formed by the diaphragm. The cover can be constructed of a polycarbonate and acrylonitrile butadiene styrene (ABS) blend.

An extent to which the cover extends over the plane of the annular peripheral portion can be configured based on a target value of a cavity resonance frequency associated with the air cavity. The target value of the cavity resonance can be higher than a cut-off frequency associated with a passband for the driver. The extent to which the cover extends over the plane of the annular peripheral portion can be configured such that voice coil rubbing in the acoustic transducer is avoided. The cover can extend over no more than one third of a cross sectional area of the plane bounded by the annular peripheral portion. The cover can be configured such that the cover fits over a part of the annular peripheral portion in conformity with a profile of the part. The part of the annular peripheral portion can be selected in accordance with a target radiation pattern associated with the acoustic transducer.

The adaptor can be constructed of a semi-flexible material. The adaptor can be constructed of acrylonitrile butadiene styrene (ABS). The adaptor can include at least one bending portion, wherein the bending portions can be configured to facilitate bending of the adaptor to conform to the convex curvature of the opening. The bending portion can include one or more channels and/or one or more hinges. The adaptor can include one or more separators disposed proximate to the multiple apertures, the separators configured to maintain separations between the acoustic passages of the manifold. The adaptor can include fastener receptacles for attaching to the manifold. The one or more drivers can include a compression driver. The profile of the opening can include a convex curvature extending outward from the speaker. The seal can define an acoustic volume for another set of one or more drivers.

The plurality of mating plates can be constructed of a semi-flexible material. The plurality of mating plates can be constructed of acrylonitrile butadiene styrene (ABS). One or more of the plurality of moving joints can include a channel. One or more of the plurality of moving joints can include a hinge. One or more separators can be disposed proximate to the aperture. The one or more separators can be configured to maintain separations between acoustic passages corresponding to different compression drivers. One or more of the plurality of mating plates can include fastener receptacles for attaching to corresponding acoustic passages associated with the compression drivers. The plurality of mating plates can be constructed of a substantially rigid material, and the movable joints can be constructed of a substantially flexible material.

Various implementations described herein may provide one or more of the following advantages.

The technology described in this document may facilitate positioning the low frequency drivers (e.g., woofers) of a speaker close to high-frequency drivers, thereby permitting a mechanically compact design for the speaker, as well as significant control over a radiation pattern of the speaker. By providing for customization of cavity resonance frequency of the low frequency drivers, the technology may provide for an acoustic output represented by a smooth frequency response. By moving the cavity resonance frequency out of a passband associated with the acoustic output, the output of the low frequency drivers in the passband may be increased. By providing an adaptor that can conform to various profiles of diffraction slot openings, manufacturing may be streamlined without giving up customizability of the adaptor.

Two or more of the features described in this disclosure, including those described in this summary section, may be combined to form implementations not specifically described herein.

The details of one or more implementations are set forth in the accompanying drawings and the description below. Other features, objects, and advantages will be apparent from the description and drawings, and from the claims.

DETAILED DESCRIPTION

Figure 1:
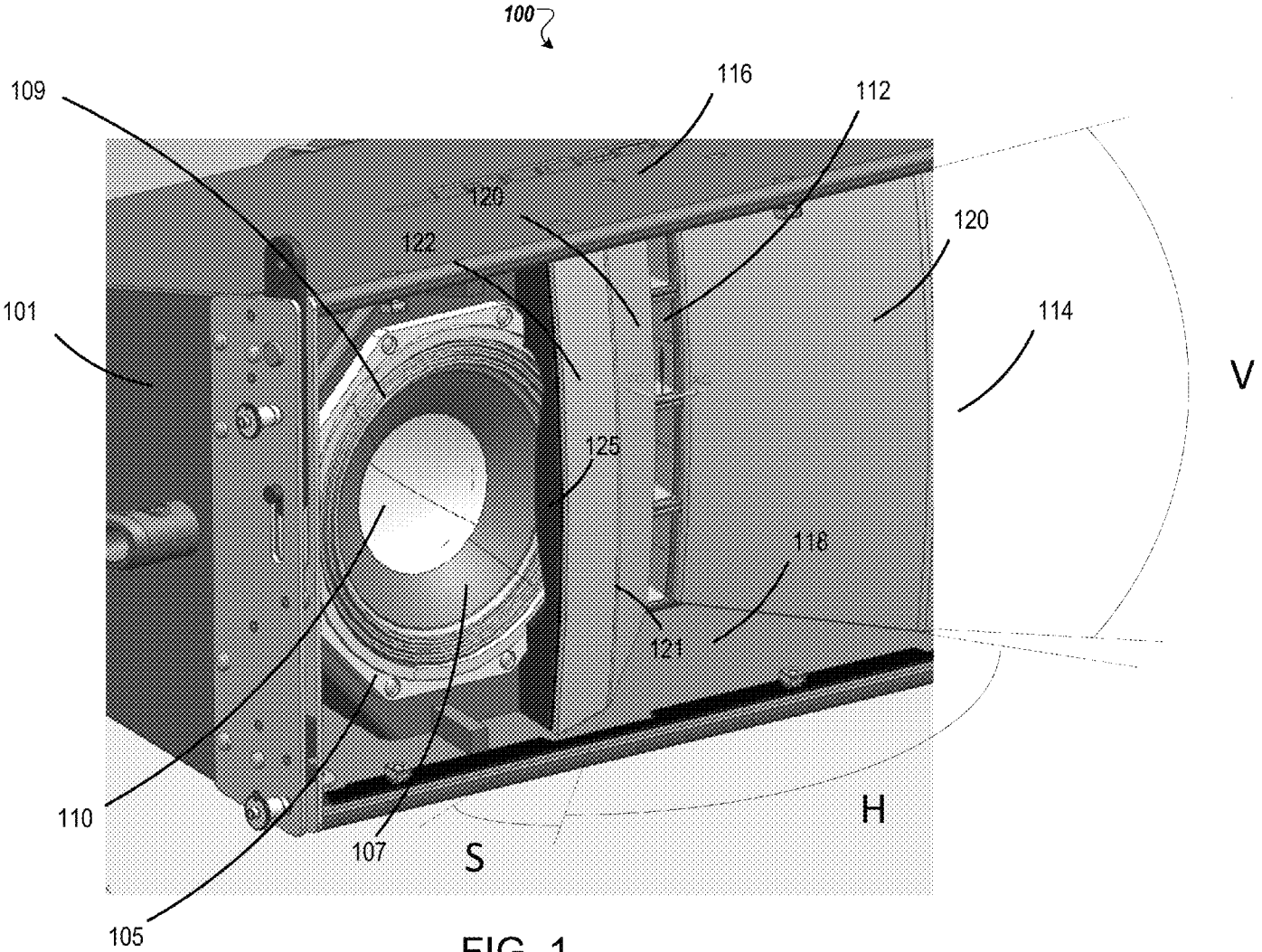
FIG. 1 is a front perspective view of an example of a speaker.

Speakers often have different acoustic drivers corresponding to different frequencies. For example, some drivers can be designed to produce low frequency sounds in the frequency range 40 Hz-1 KHz. Such drivers may be referred to as woofers. Other drivers can be designed to produce high frequency sound (for example, 2 KHz-20 KHz). Examples of such high-frequency drivers include compression drivers and tweeters. Both high and low frequency drivers can be electrodynamic or electro-acoustic drivers. For example, a low frequency electrodynamic driver can include a rigid or semi-rigid conical portion (also referred to as a driver cone or diaphragm) that is driven by an attached voice coil. Current flowing through the voice coil causes the coil to push or pull on the driver cone in a piston-like way, which vibrates air within an enclosure of the speaker to create sound waves.

An air cavity associated with a given driver has associated with it an acoustic resonance frequency. This may be referred to as the cavity resonance frequency. The air cavity can include, for example, a volume of air between the driver and an enclosure of the speaker. The cavity resonance frequency associated with a driver may cause nulls in the frequency response of the corresponding driver at mid to high frequencies, thus suppressing the acoustic outputs at those frequencies and therefore reducing the acoustic energy output from the driver. For example, the diaphragm or cone of the driver may be sensitive to the acoustic resonance of the enclosure cavity. In such cases, the functioning of the diaphragm may be hindered at the cavity resonance frequencies, thereby resulting in notches or nulls in the frequency response curve of the driver. In some cases, if the cavity resonance frequency is within a usable passband of the driver, the acoustic output is adversely affected by the cavity resonance frequency.

The technology described in this document provides for a cover that at least partially extends over the diaphragm of a driver. Such a cover can be configured to affect an associated cavity resonance frequency of an air cavity adjacent to the diaphragm. For example, an extent to which such a cover occupies the volume of the air cavity determines the cavity resonance associated with the air cavity adjacent to the diaphragm. For example, a cover disposed to partially extend over the diaphragm can be designed such that the cover occupies a volume of the air cavity. This in turn reduces the volume of the air cavity and may affect the associated cavity resonance frequency. The location and dimensions of the cover can therefore be designed such that adverse effects of a resulting cavity resonance frequency on the frequency range of the driver is eliminated or at least substantially mitigated. For example, the cover can be configured such that the volume of the air cavity adjacent to the diaphragm is reduced, and the corresponding cavity resonance is tuned to a value outside the usable passband of the driver.

FIG. 1 shows a front perspective view of an example of a speaker 100 in accordance with technology described herein. The housing 101 of the speaker 100 includes one or more low-frequency electro-acoustic drivers 105. FIG. 1 shows only one such low-frequency driver 105 that includes a conical diaphragm 107. The diaphragm 107 is disposed between an annular peripheral portion 109 (also referred to as the rim) and the central portion 110 of the driver 105. In some implementations, the central portion 110 may be referred to as a dust cap. The volume between the front of the enclosure and the central portion 110 can form the air cavity associated with the driver. The speaker 100 can also include one or more high frequency drivers (e.g., compression drivers) each connected to a corresponding opening 112 (also referred to as a diffraction slot). In the example shown, the speaker 100 includes four high frequency drivers (not visible in the view depicted in FIG. 1), two of which are disposed behind each of the two low frequency drivers 105.

In some implementations, the speaker 100 includes a horn 114 that radiates the acoustic output of the one or more high frequency drivers emanating from the diffraction slots 112. The horn 114 can be configured in accordance with a target radiation pattern for the acoustic output of the high frequency drivers. For example, the horn 114 may be configured in accordance with a radiation pattern defined by a horizontal coverage angle H and a vertical coverage angle V over which the speaker 100 projects the acoustic output coming from the high frequency drivers. In some implementations, the radiation pattern may be realized by setting an angle between the top surface 116 and the bottom surface 118 of the speaker in accordance with V, and setting an angle between the side panels 120 of the horn 114 in accordance with H. In some implementations, the angle H is substantially equal to 70°. In some implementations, the horn 114 can have, on each side, a secondary side panel 122 disposed at an angle S with the corresponding side panel 120 along a hinge 121. The secondary side panel can provide additional configurability to control the radiation pattern associated with the horn 114.

Figure 2A:
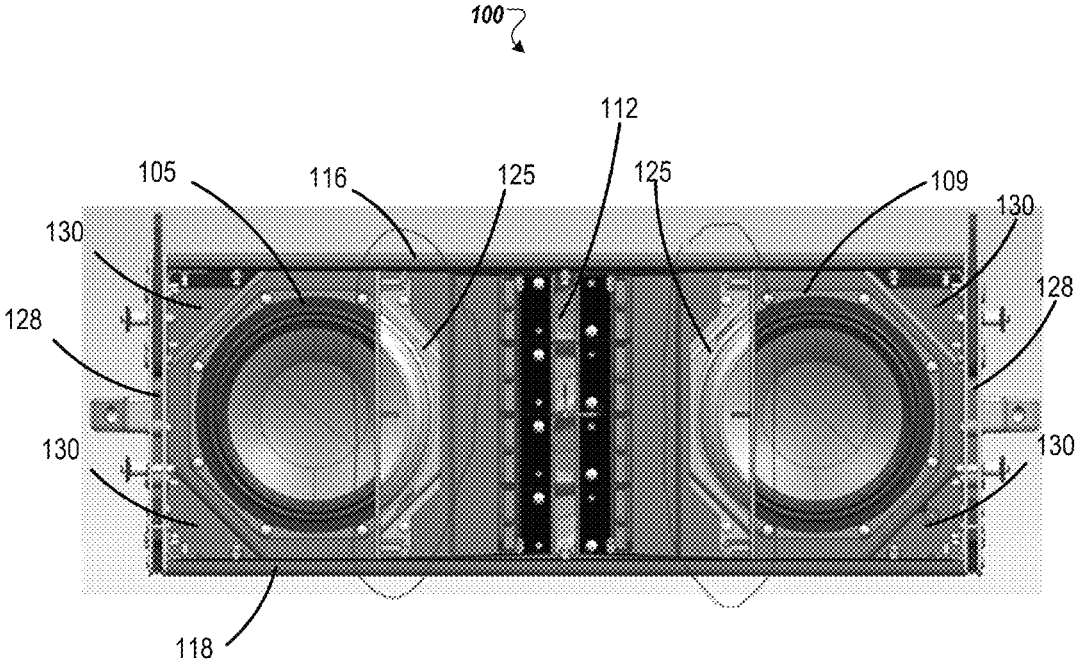
FIGS. 2A and 2B are front views of the speaker of FIG. 1.

The speaker 100 can also include a cover 125 configured to partially extend over the diaphragm 107 to affect the cavity resonance frequency of an air cavity of a low frequency driver 105. In the example of FIG. 1, the cover 125 is disposed behind the secondary panel 122 of the horn 114. FIG. 2A, which shows a front view of the speaker of FIG. 1, illustrates exemplary locations of the covers 125 on the two low frequency drivers 105. In the example of FIG. 2A, each cover 125 is positioned over an inside end that is closer to the diffraction slots 112 than an outer end adjacent to a corresponding sidewall 128 of the speaker housing 101. However, in other implementations, the cover 125 can be placed elsewhere on the periphery of the low frequency driver 105. For example, the cover 125 may be positioned on the periphery of the driver 105 over an upper end (i.e., the end adjacent to the top surface 116), lower end (i.e., the end adjacent to the bottom surface 118), or the outer end. The location of the cover can be selected, for example, based on a target radiation pattern of the speaker 100.

Figure 2B:
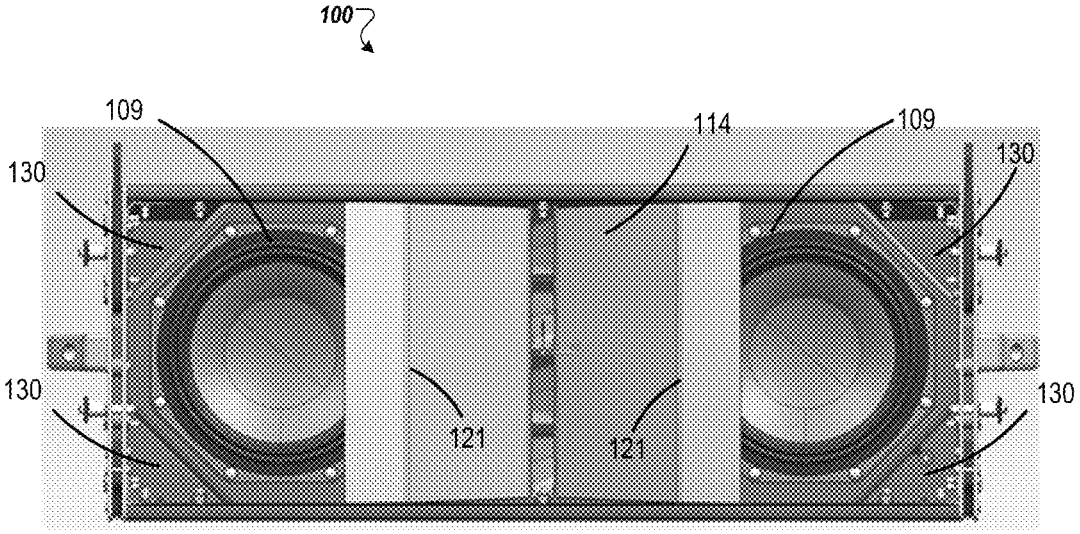

In some implementations, multiple covers 125 may also be used. For example, in addition to a cover disposed on the inner end of the driver 105 (as shown in FIG. 2A), a second cover (not shown) may be disposed on the outer end, or elsewhere on the periphery. The cover 125 may be disposed, at least in part, behind the horn 114. This is depicted in FIG. 2B, where the covers 125 are occluded by the secondary side panels of the horn 114. In some implementations, the cover 125 is configured such that the cover fits over a part of the annular peripheral portion in conformity with a profile of the part.

The dimensions of the cover 125 can be designed based on various considerations. For example, the cover 125 can be designed to reduce the volume of the air cavity associated with the corresponding low frequency driver. This may be done in a way such that a cavity resonance frequency associated with the resulting air cavity is outside a passband (or at least at a location where the cavity resonance does not significantly affect the passband) associated with the driver. In some implementations, the cover 125 can be designed to extend over the diaphragm 107 of the corresponding low frequency driver 105 in a way such that the resulting cavity resonance frequency is higher than a cut-off frequency associated with a passband for the speaker device or the low frequency driver. For example, if the cutoff frequency for the passband associated with the low frequency driver is around 500 Hz, the cover can be designed such that the cavity resonance frequency is at a value (e.g., 750 Hz) higher than the cutoff frequency. The desired value of the cavity resonance frequency may be referred to as a target value.

In some implementations, the cover may be designed based on crossover frequencies associated with a frequency response of the speaker. Such design can include, for example, how much of the air cavity is occupied by the cover. In a speaker system that includes both low frequency drivers and high frequency, the crossover frequencies may represent a frequency range where the gain of the low frequency drivers rolls off and the gain of the high frequency drivers ramps up. In such cases, the cover 125 can be designed such that the cavity resonance frequency is a value within the crossover frequency range, and results in a smooth overall frequency response for the speaker. In some implementations, the cover 125 can be designed such that the cavity resonance frequency is a value outside the crossover frequency range. For example, the cover may be designed such that the cavity resonance frequency is higher than the crossover point associated with the driver.

In some implementations, the dimensions of the cover 125 may be experimentally or heuristically determined based on, for example, a trade-off between cavity resonance tuning and resulting pressure imbalance within the air cavity. For example, in some cases, it may be desirable to extend the cover over a large portion of the diaphragm 107 to tune the cavity resonance frequency to a high value outside of the passband of the corresponding low frequency driver. However, covering the diaphragm 107 over a threshold extent may cause a pressure imbalance between the air cavity and the outside environment. Specifically, if high pressure created by the diaphragm within the air cavity is not vented out (e.g., due to the cover 125 extending beyond a threshold amount), the pressure may cause the voice coil of the driver to rub against other portions such as a pole piece adjacent to the voice coil. This in turn results in undesirable acoustic effects that may be referred to as a rocking mode. The extent to which the cover 125 extends over the diaphragm (and consequently within the volume of the air cavity) may be determined such that the cavity resonance frequency is tuned without causing cone stress (fatigue) or voice coil rubbing due to cone breakup.

Figure 3A:
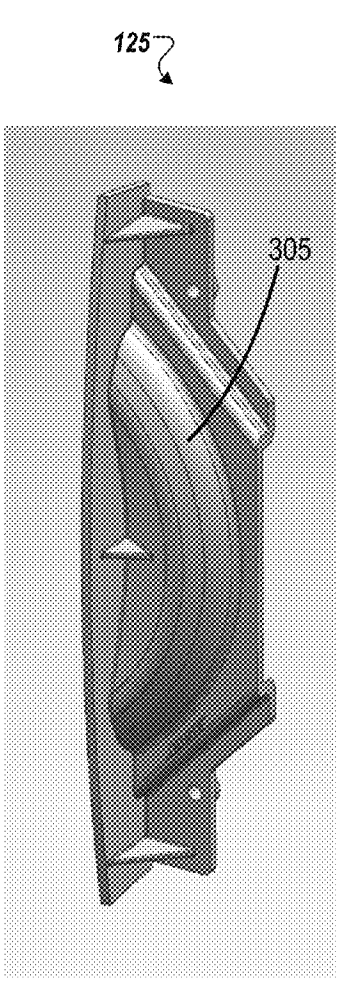
FIGS. 3A-3D show a front perspective view, a back perspective view, a side view, and a front view, respectively, of an example cover that extends partially over an air cavity associated with a low frequency driver of the speaker of FIG. 1.
Figure 3B:
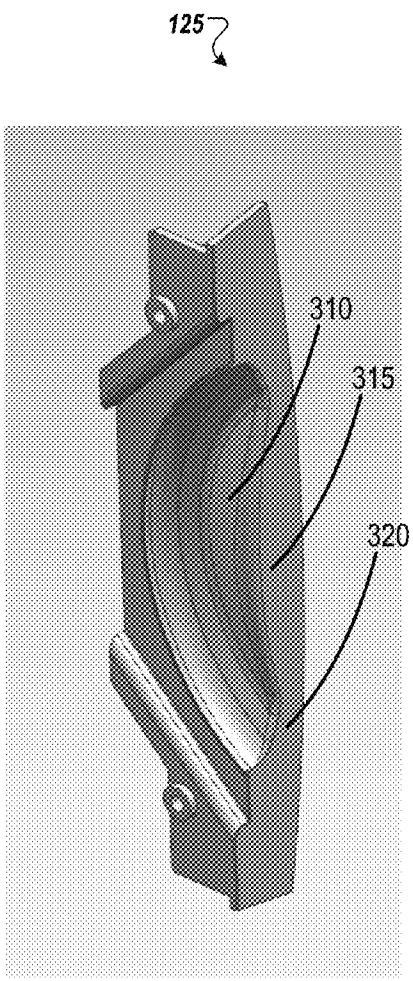
Figure 3C:
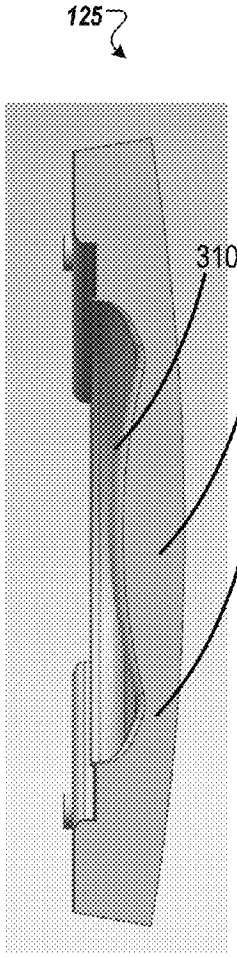
Figure 3D:
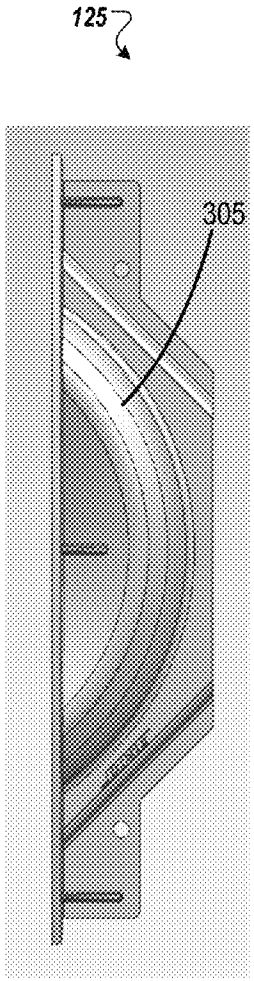
Figure 3E:
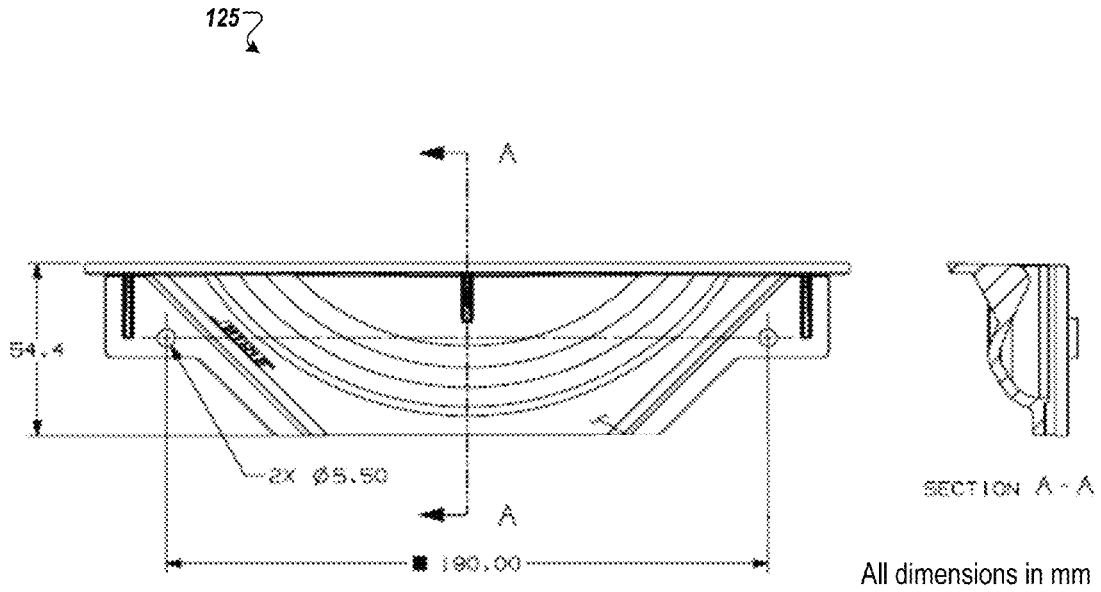
FIGS. 3E and 3F show various dimensions associated with an example cover.
Figure 3F:
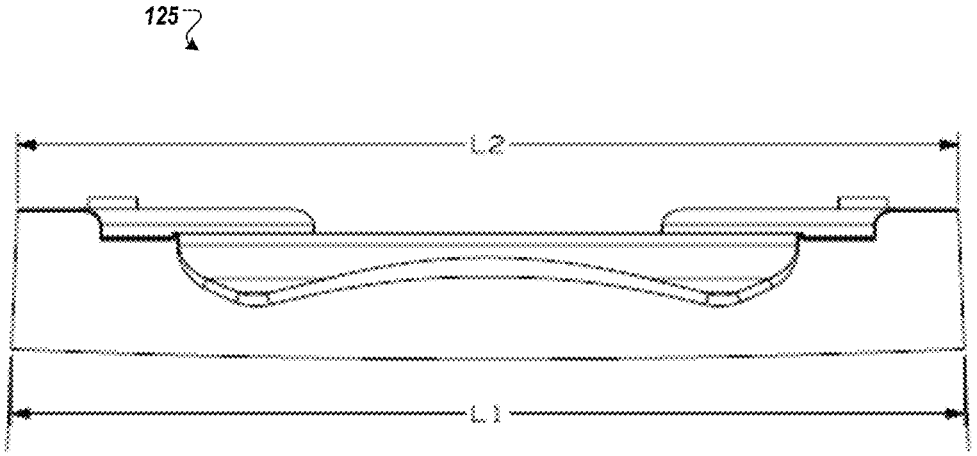

FIGS. 3A-3D show a front perspective view, a back perspective view, a side view, and a front view, respectively, of an example cover 125. In some implementations, the overall dimension of the cover 125 can be configured such that the cover 125, when attached over a portion of a low frequency driver 105, does not cover more than one third of the cross-sectional area of a plane encompassed by the annular peripheral portion 109 of the driver. In some cases, this may ensure that the cavity resonance frequency is tuned to the target value without causing an onset of rocking modes in the corresponding driver. For example, the cover 125 can be designed such that the cover extends over the diaphragm 107 in a way that 10%, 15%, 20%, or 30% of the cross sectional area of the portion of the plane encompassed by the annular peripheral portion 109. FIGS. 3E and 3F show some example dimensions for a cover 125. The example depicted in FIG. 3E is designed to extend over approximately 20% of a cross sectional area of the plane encompassed by an annular peripheral portion of a low frequency driver. The dimensions in FIG. 3F are represented in terms of the parameters L1, L2. Some example combinations of the parameters are given below in Table 1.

TABLE 1

| L1 | L2 |
|---|---|
| 241.31 mm | 238.22 mm |
| 250.48 mm | 244.76 mm |
| 268.30 mm | 258.93 mm |

Figure 4A:
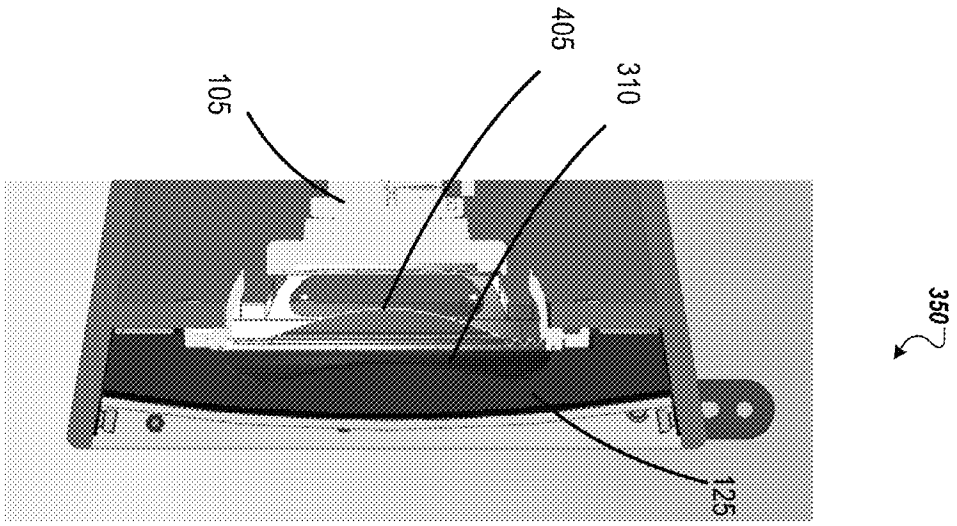
FIGS. 4A and 4B show a side sectional view and a top sectional view of a portion of the speaker of FIG. 1.
Figure 4B:
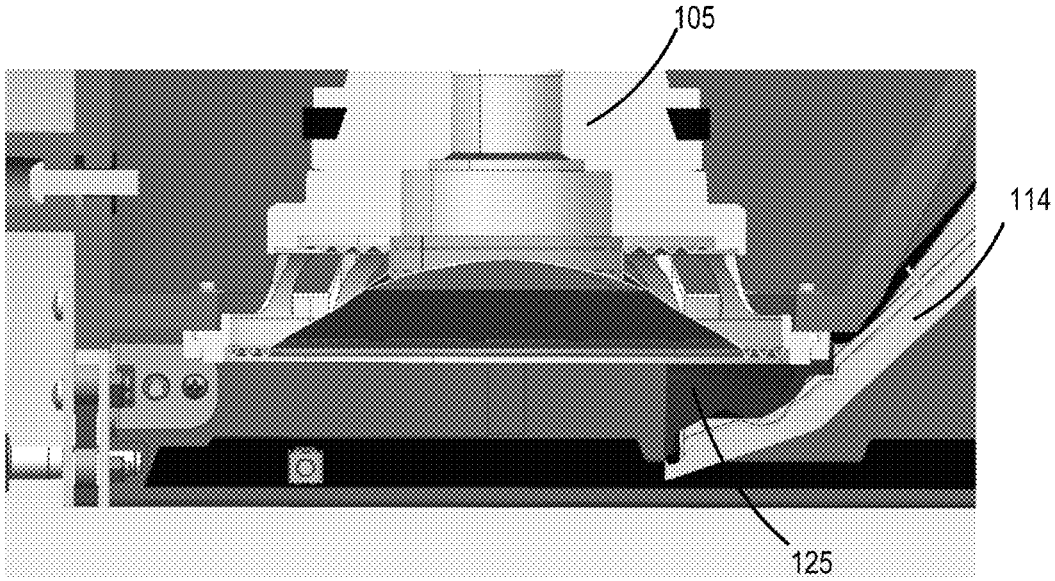

In some implementations, the cover 125 can include a fitting portion 305 configured to fit the cover 125 over a portion of the rim 109 of the low frequency driver 105. As shown in FIGS. 3B and 3C, the back surface 310 can be shaped such that the surface 310 matches a profile associated with the corresponding low frequency driver 105. In some cases, this may mitigate any abnormal stress on the driver resulting from the cover extending over a portion of the diaphragm 107. This is further illustrated in the example of FIG. 4A (a side sectional view of a portion of the speaker 100), which shows how the back surface 310 of the cover 125 conforms to a profile 405 of the low frequency driver 105. In some cases, the back surface 310 can be configured to reduce the volume of the air cavity in which the cover 125 extends. For example, the thickness of a central portion 315 (as illustrated in the back perspective view and the side view of FIGS. 3B and 3C, respectively) can be configured to be more than the thickness of a peripheral portion 320 to reduce the volume of any air cavity over which the cover 125 is disposed. In some implementations, the front profile of the cover 125 can be configured to mate with a portion of the horn, possibly in a sealing configuration. This is illustrated in the example of FIG. 4B (and a top sectional view of a portion of the speaker 100), where the front face of the cover 125 is configured to conform to the back surface of a corresponding portion of the horn 114.

Figure 5B:
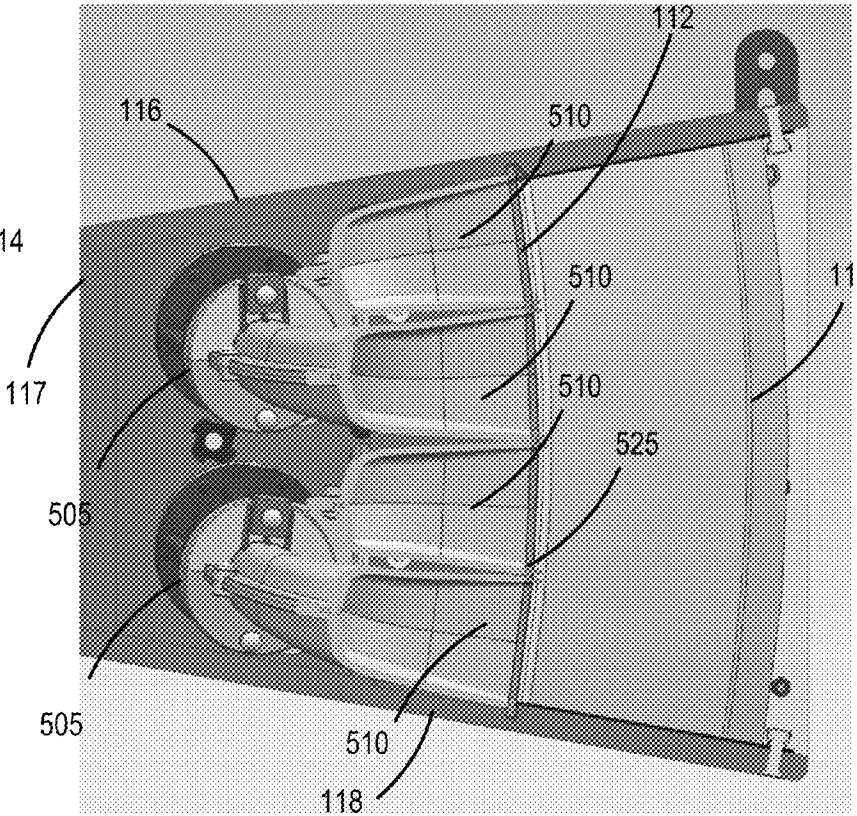
FIGS. 5A and 5B show side sectional views of the speaker of FIG. 1 exposing a manifold connected to high frequency drivers.
Figure 5A:
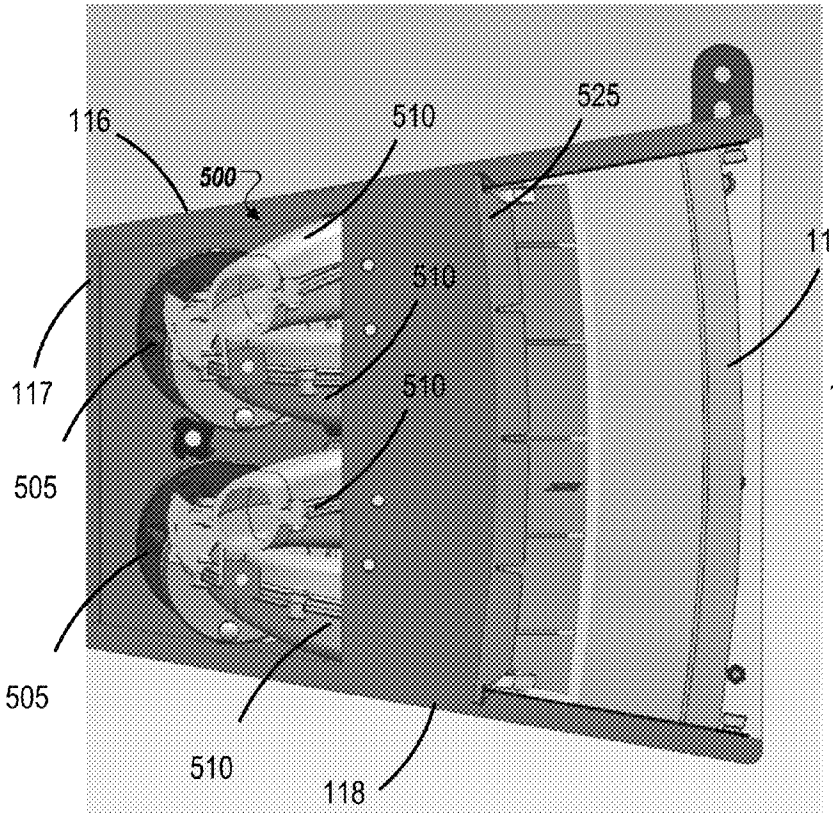
Figure 5C:
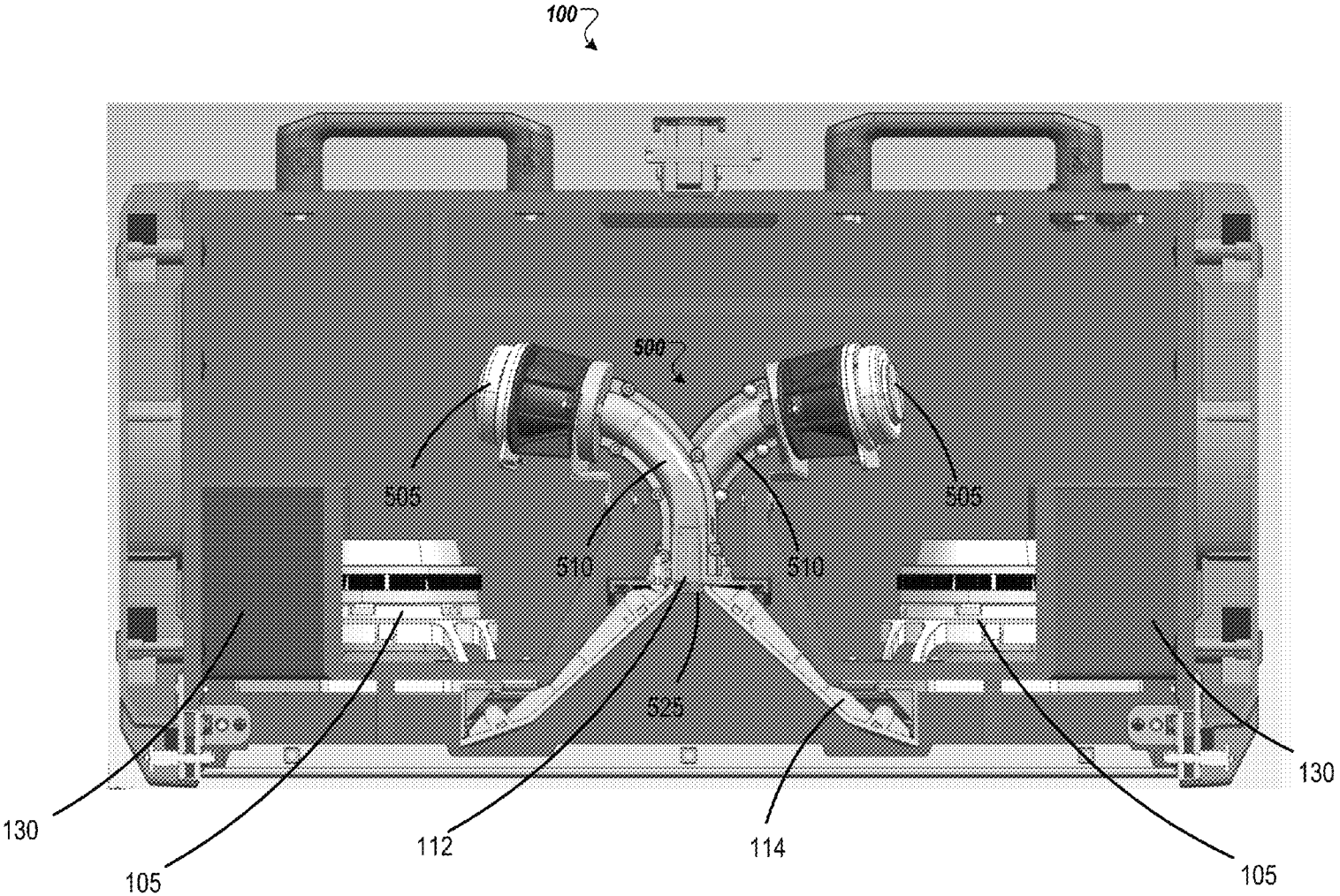
FIG. 5C shows a top sectional view exposing the manifold disposed within the speaker of FIG. 1.

FIGS. 5A and 5B show side sectional views of the speaker 100 exposing a manifold 500 connected to the high frequency drivers. FIG. 5C shows a top sectional view that illustrates the location of the manifold within the speaker 100. As shown in these figures, the manifold 500 includes one or more acoustic passages 510, each having an output opening coupled to a corresponding diffraction slot opening 112. An input opening of each of the acoustic passages 510 is connected to a corresponding high frequency driver 505. In the example shown in FIGS. 5A-5C, the manifold 500 includes four acoustic passages 510. The acoustic passages 510 curve away from the output opening in a direction towards the corresponding high frequency drivers 505. In the present example, two of the acoustic passages 510 curve towards the corresponding high frequency drivers located behind one low frequency driver 105, and the other two acoustic passages 510 curve towards the other high frequency drivers located behind the second low frequency driver 105.

The high frequency drivers 505, (e.g., compression drivers or tweeters), can be of various types. In some implementations, the high frequency drivers 505 include an electrodynamic or electroacoustic driver using a voice coil disposed within a fixed magnetic field. In such drivers, the voice coil can be configured to produce a varying magnetic field that interacts with the fixed magnetic field to move the voice coil and a diaphragm attached to the voice coil. The mechanical movement of the voice coil (and diaphragm) can be in accordance with a signal provided by an amplifier. The movement of the diaphragm in turn vibrates the air and produces audible sound. In some implementations, the drivers 505 can include a compression driver, which can include, for example, a metal diaphragm that is vibrated by a signal current in a coil of wire between the poles of a cylindrical magnet. The sound waves produced by a high frequency driver 505 traverse the corresponding acoustic passage 510 and is radiated out of the diffraction slots 112 in a radiation pattern governed by the configuration of the acoustic horn 114.

In some implementations, the speakers 100 include an adaptor 525 disposed between the manifold 500 and the acoustic horn 114. The adaptor 525 can be constructed, for example, of a semi-flexible material (e.g., acrylonitrile butadiene styrene (ABS), or a blend of polycarbonate and ABS) to conform to an outward profile of the diffraction slots. For example, the four acoustic passages 510 shown in FIGS. 5A and 5B together form an outwardly convex profile of the diffraction slots. In such cases, the adaptor 525 (which may also be referred to as a keel or keel element) can be configured to interface between the acoustic passages 510 and the horn 114 in a way that the adaptor 525 forms a seal between the diffraction slots and the horn 114 for various profiles (e.g., the convex curvature) of the diffraction slots.

Figure 6:
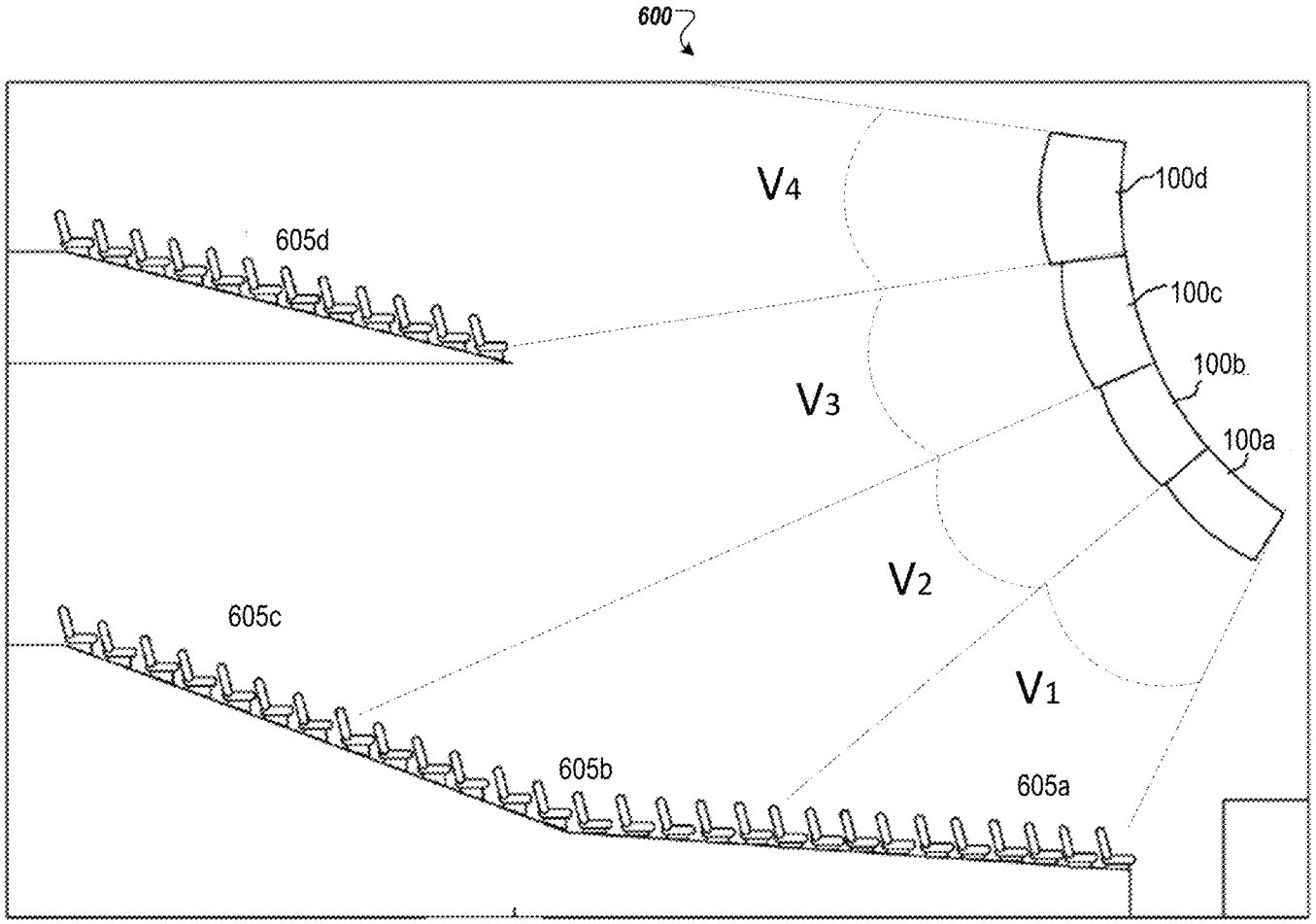
FIG. 6 shows a side elevation view of a speaker array in a venue.

The profiles of the diffraction slots can vary from one speaker to another. In some implementations, multiple speakers 100 are stacked together to deliver sound to different parts of a large venue. Such a situation is depicted in FIG. 6, where an array of speakers 100*a*-100*d* deliver sound to a large venue 600 such as a concert hall. Such a venue 600 may be divided into multiple acoustic zones 605*a*-605*d* (605, in general), and one or speakers 100 may be configured to deliver sound to each of the acoustic zones. In such cases, the vertical angles $V_1$-$V_4$ associated with the speakers 100*a*-100*d*, respectively, may vary from one another, and the profile of the diffraction slot of each speaker may be configured in accordance with the corresponding vertical angle. In some implementations, the edges of a horn that mate with a corresponding diffraction slot are curved in a manner that corresponds to the curvature of the profile of the corresponding diffraction slot. The outward profile of the horn (e.g., as defined by an outward curvature of the secondary panel 122 and/or the hinge 121 described with reference to FIG. 1) may also be curved in a vertical direction. In some implementations, the diffraction slot profiles and/or the horn profiles of the multiple speakers 100*a*-100*d* may be configured in a way such that the profiles of the multiple speakers together form a continuous or substantially continuous arc. In some implementations, in order to facilitate such stacking of multiple speakers in an arc, the top surface 116 and the bottom surface 118 of the individual speakers 100 can be disposed at an angle, as illustrated in FIGS. 5A and 5B. The top surface 116 and the bottom surface 118 can be connected by the rear wall 117.

Figure 7D:
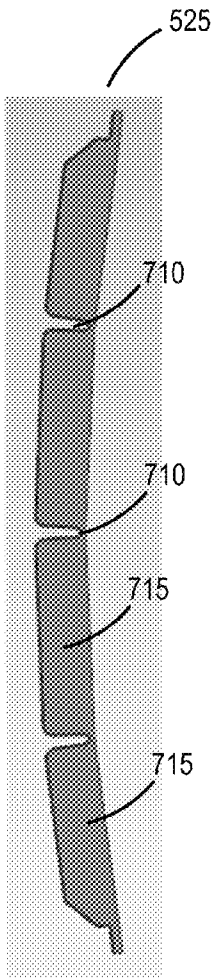
FIGS. 7A-7D show various views of an example of an adaptor disposed within the speaker of FIG. 1.
Figure 7C:
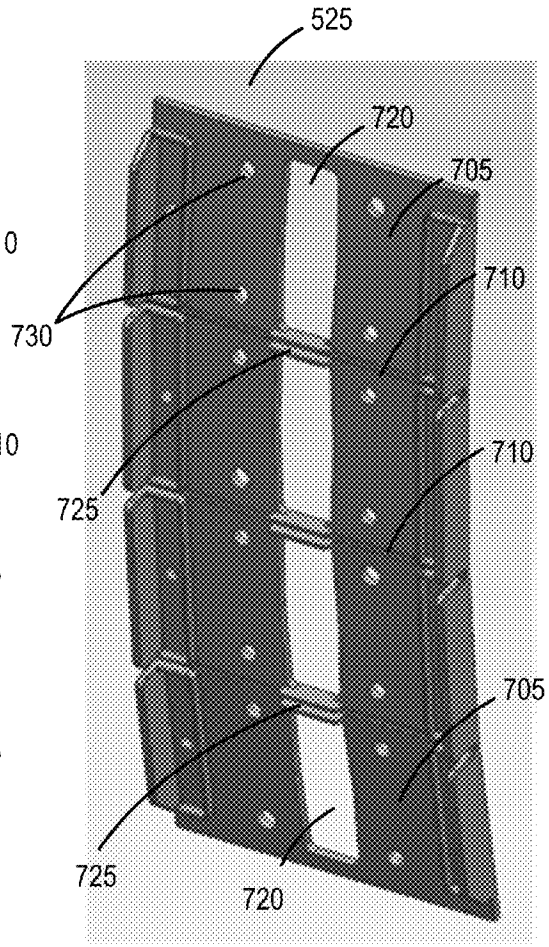
Figure 7B:
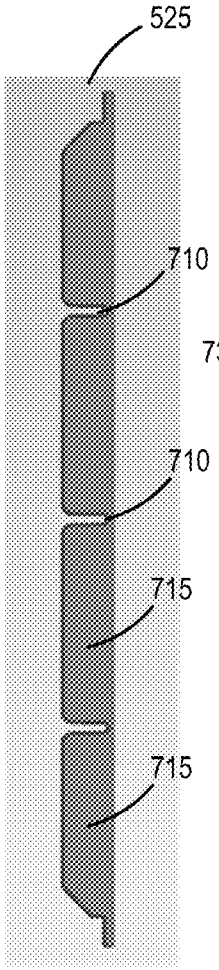
Figure 7A:
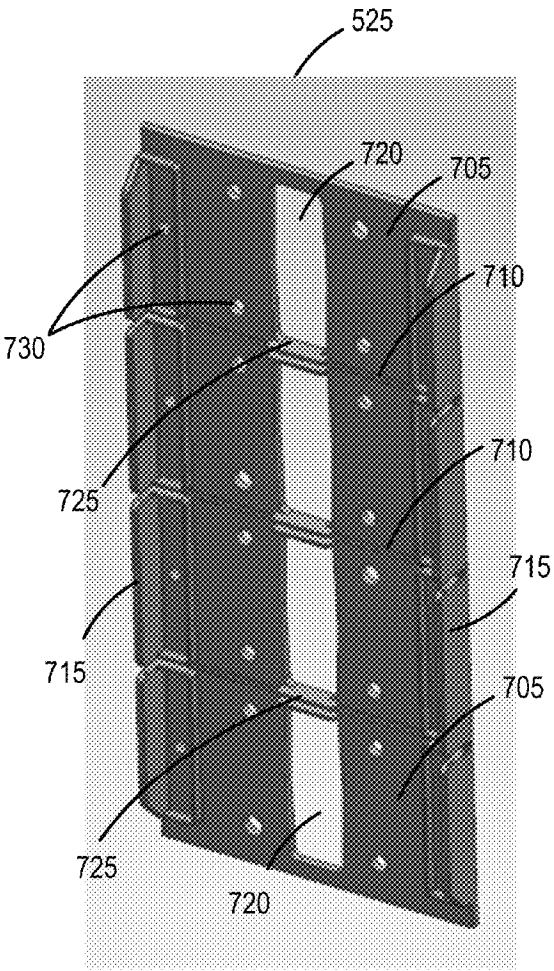

By providing an adaptor 525 that conforms to various diffraction slot profiles, the need for manufacturing customized profile-dependent adaptors may be obviated, thereby potentially reducing complexities in the manufacturing process. FIGS. 7A-7D show various views of an example of such a conformable adaptor 525. Specifically, FIGS. 7A and 7B show a perspective front view and a side view, respectively of an adaptor 525 in a non-deformed configuration. FIGS. 7C and 7D show a perspective front view and a side view, respectively, of the adaptor 525 in a configuration where the adaptor 525 is deformed in an outwardly convex shape. In some implementations, the adaptor 525 can include multiple panels 705, such that two consecutive panels 705 are joined along a bending portion 710. The bending portions 710 may act as living hinges that allow the adaptor to conform to various profiles of the diffraction slots. In some implementations, the bending portion 710 can include a channel or recess that allows the two panels attached to the bending portion 710 to be disposed at an angle with one another.

In some implementations, the adaptor 525 includes multiple apertures 720 each configured to provide an acoustic pathway between a corresponding acoustic passage 510 and the horn 114 of the speaker. The adaptor 525 can be configured to maintain a seal between the acoustic passages 510 and the horn 114 such that the acoustic waves propagated through the acoustic passages 510 are radiated outward through the horn 114 without significant losses. For example, the adaptor 525 can include projections 715 on both sides of the panels 705 to engage with the horn 114 in a sealing configuration. In some implementations, the adaptor 525 also includes one or more separators 725 disposed proximate to one or more of the apertures 720. The separators 725 may be provided, for example, to maintain separations between adjacent acoustic passages 510 connected to the adaptor 525. In some implementations, the adaptor 525 also provides a seal for the acoustic volume associated with the one or more low frequency drivers 105 of the speaker. For example, the adaptor 525 can provide a seal around its periphery to separate the horn 114 from an acoustic volume of the low-frequency drivers located within the speaker housing.

Figure 7H:
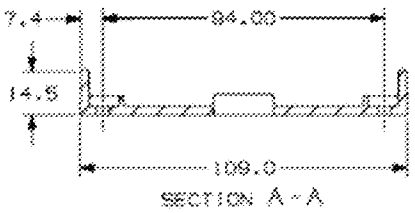
FIGS. 7E-7H show various dimensions associated with an example adaptor.
Figure 7G:
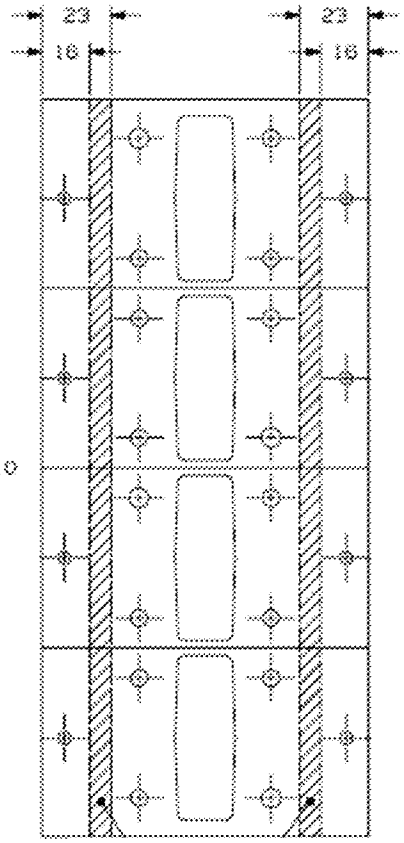
Figures 7E, 7F:
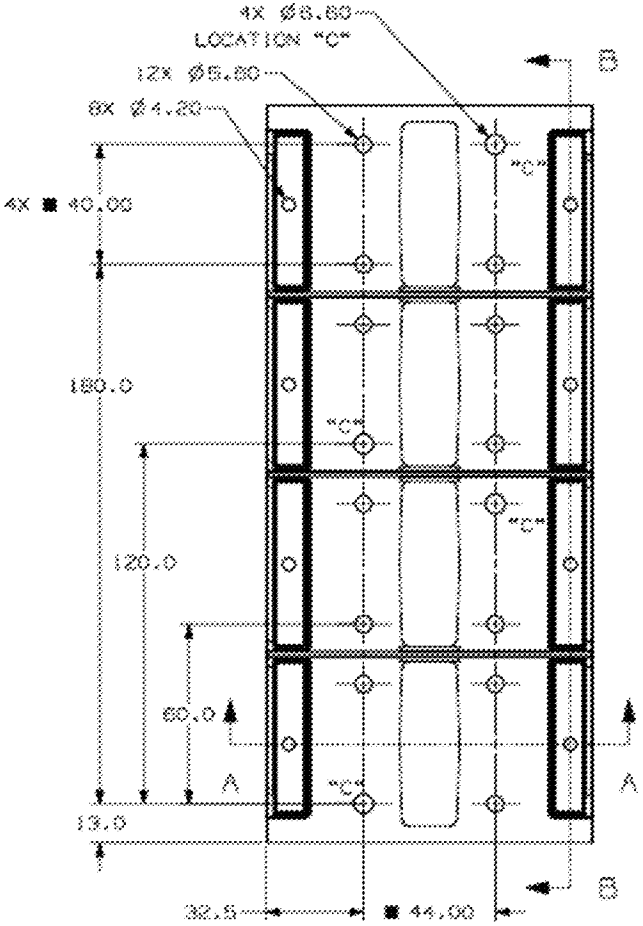

The adaptor 525 can be attached to the horn 114 and the acoustic passages 510 of the manifold 500 in various ways. In some implementations, the adaptor 525 can be adhesively coupled to one or more of the horn 114 and the manifold 500. In some implementations, the adaptor 525 can include one or more fastener receptacles 730 for coupling the adaptor to the horn 114 and/or the manifold 500 using fasteners such as screws. FIGS. 7E-7H show various dimensions associated with an example adaptor. In particular, FIG. 7E shows the dimensions in a front view of the adaptor and FIGS. 7F-7H show the dimensions in a side view, back view, and top view, respectively, of the example adaptor.

In some implementations, the speaker 100 can include one or more ports, for example, to improve bass responses of the low frequency drivers. Such ports can include, for example, a passage that connects that interior of the speaker housing to the outside environment. Example locations of ports 130 for the speaker 100 are shown in FIGS. 2A, 2B, and 5C. When the diaphragms of a low frequency driver moves back and forth, such movement causes the air within the speaker housing or cabinet to move, and vent out of the one or more speaker ports. In some implementations, the dimensions and/or shape of the ports can be designed such that the air movement through the one or more ports produce audible sounds at one or more frequencies. In some implementations, one or more of the ports 130 of the speaker 100 may be sealed from the outside environment, for example, to replicate the performance of a speaker without the corresponding port.

Figure 8A:
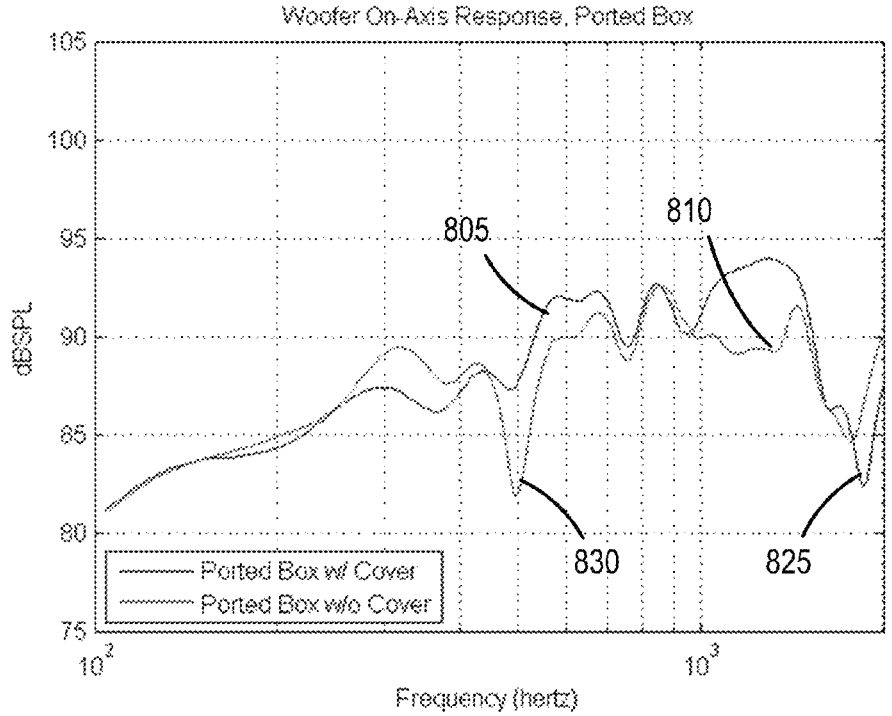
FIGS. 8A and 8B are plots representing frequency response curves for various configurations of the speaker of FIG. 1.
Figure 8B:
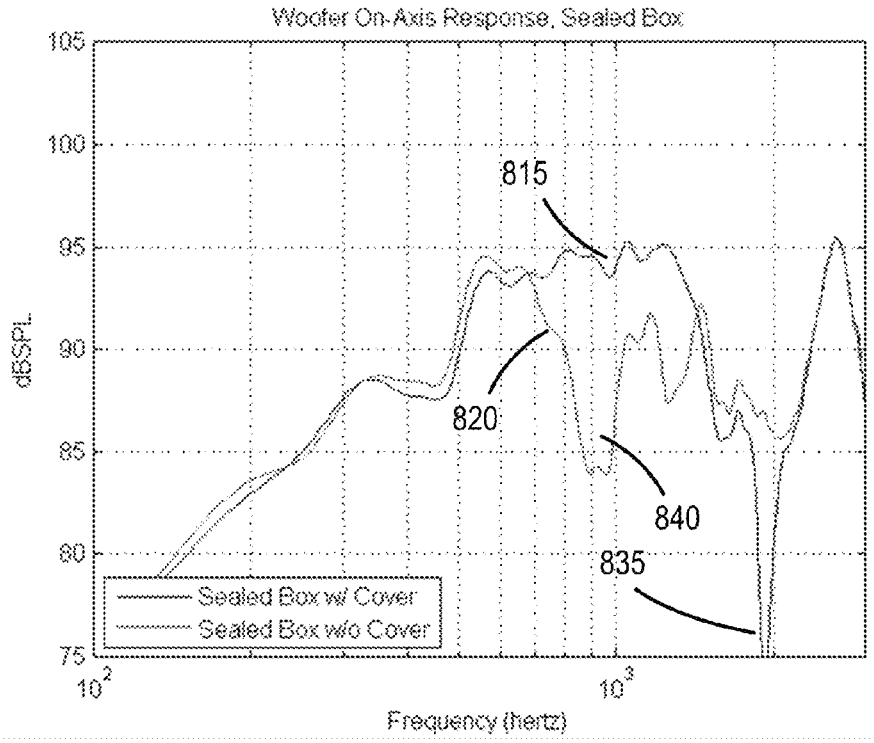

FIGS. 8A and 8B show a plots that visually represent examples of technical effects achieved by using the cover 125 described above. Specifically, the FIG. 8A represents the frequency response curves that were obtained for ported configurations of the speaker 100 with or without using a cover. The curve 805 represents the frequency response of a low frequency driver using the cover 125 in conjunction with two ports. The curve 810 represents the frequency response of the low frequency driver without the cover 125 but with the two ports. In FIG. 8B, the curves 815 and 820 represent the frequency responses for the configurations with and without the cover, respectively, when the two ports are sealed from the environment. The notches 825, 830, 835, and 840 represent the locations of the cavity resonance frequencies in the corresponding configurations. The locations of the notches 825 and 830, as well as the nature of the corresponding frequency response curves 805 and 810, respectively, indicate that for the ported configurations, using the cover 125 caused the cavity resonance frequency to be driven up to a high value as compared to the lower value measured for the case without the cover. Similarly, the locations of the notches 835 and 840, as well as the nature of the corresponding frequency response curves 815 and 820, respectively, indicate that for the sealed port configurations too, using the cover 125 caused the cavity resonance frequency to be driven up to a high value as compared to the lower value measured for the case without the cover.

Other embodiments not specifically described herein are also within the scope of the following claims. Elements of different implementations described herein may be combined to form other embodiments not specifically set forth above. Elements may be left out of the structures described herein without adversely affecting their operation. Further-more, various separate elements may be combined into one or more individual elements to perform the functions described herein.

What is claimed is:

1. A speaker, comprising:

a housing;

at least one electro-acoustic driver including a diaphragm; and a cover secured to one or more of the housing and driver, the cover configured to partially extend over the diaphragm to affect an associated cavity resonance frequency of an air cavity adjacent to the diaphragm, wherein the cover extends over no more than one third of a cross sectional area of an open end of a conical structure formed by the diaphragm.

2. The speaker of claim 1, wherein an extent to which the cover partially extends over the diaphragm is configured based on a target value of the cavity resonance frequency.

3. The speaker of claim 2, wherein the target value of the cavity resonance frequency is higher than a cut-off frequency associated with a passband for the driver.

4. The speaker of claim 2, wherein the extent to which the cover partially extends over the diaphragm is configured such that voice coil rubbing inside the speaker is avoided.

5. The speaker of claim 1, wherein the at least one electro-acoustic driver is associated with low-frequency components of audio produced by the speaker.

6. The speaker of claim 1, further comprising an acoustic horn that includes a first side panel and a second side panel, edges of the first and second side panels defining an opening for receiving acoustic outputs from one or more high-frequency drivers.

7. The speaker of claim 6, wherein the opening is disposed proximate to an inside end of the at least one electro-acoustic driver, the inside end being opposite to an outside end of the at least one acoustic driver, wherein the outside end is closer than the inside end to an exterior sidewall of the housing.

8. The speaker of claim 6, further comprising a manifold disposed between the opening and the one or more high-frequency drivers, the manifold including a plurality of acoustic passages for connecting the opening to each of the one or more high-frequency drivers.

9. The speaker of claim 8, wherein the opening has a convex curvature extending outward from the housing.

10. The speaker of claim 9, further comprising an adaptor disposed between the manifold and the acoustic horn, the adaptor including a plurality of apertures for the acoustic outputs from the one or more high-frequency drivers to radiate from the plurality of acoustic passages to the acoustic horn.

11. The speaker of claim 10, wherein the adaptor is semi-flexible, and configured to conform to the convex curvature of the opening.

12. The speaker of claim 10, wherein the adaptor includes a plurality of bending portions configured to allow the adaptor to conform to the convex curvature of the opening.

13. The speaker of claim 1, wherein the cover is constructed of a polycarbonate and acrylonitrile butadiene styrene (ABS) blend.

14. An acoustic transducer comprising:

a driver cone comprising:

a central portion, an annular peripheral portion, and a diaphragm between the central portion and the peripheral portion, wherein the central portion, the annular peripheral portion, and the diaphragm together form a closed end of an air cavity adjacent to the driver cone;

an electrodynamic driver configured to move the driver cone to vary pressure levels within the air cavity in accordance with an electrical signal; and a cover disposed in contact with the annular peripheral portion such that the cover extends over a portion of a plane of the annular peripheral portion to affect an associated cavity resonance frequency of the air cavity, wherein the cover extends over no more than one third of a cross sectional area of the portion of the plane bounded by the annular peripheral portion.

15. The acoustic transducer of claim 14, wherein an extent to which the cover extends over the plane of the annular peripheral portion is configured based on a target value of a cavity resonance frequency associated with the air cavity.

16. The acoustic transducer of claim 15, wherein the target value of the cavity resonance is higher than a cut-off frequency associated with a passband for the driver.

17. The acoustic transducer of claim 15, wherein the extent to which the cover extends over the plane of the annular peripheral portion is configured such that voice coil rubbing in the acoustic transducer is avoided.

18. An acoustic transducer comprising:

a driver cone comprising:

a central portion, an annular peripheral portion, and a diaphragm between the central portion and the peripheral portion, wherein the central portion, the annular peripheral portion, and the diaphragm together form a closed end of an air cavity adjacent to the driver cone;

an electrodynamic driver configured to move the driver cone to vary pressure levels within the air cavity in accordance with an electrical signal; and a cover disposed in contact with the annular peripheral portion such that the cover extends over a portion of a plane of the annular peripheral portion to affect an associated cavity resonance frequency of the air cavity, wherein the cover is configured such that the cover fits over a part of the annular peripheral portion in conformity with a profile of the part.

19. The acoustic transducer of claim 18, wherein the part of the annular peripheral portion is selected in accordance with a target radiation pattern associated with the acoustic transducer.

20. A speaker comprising:

a housing enclosed by two sidewalls, a rear wall, a top surface, and a bottom surface;

two or more low-frequency drivers disposed within the housing such that front faces of the low-frequency drivers are substantially parallel to the rear wall of the housing;

a cover disposed over each of the two or more low-frequency drivers such that the cover partially extends over a diaphragm of the corresponding low-frequency driver to affect an associated cavity resonance frequency of an air cavity adjacent to the diaphragm, wherein the cover extends over no more than one third of a cross sectional area of an open end of a conical structure formed by the corresponding diaphragm;

one or more high-frequency drivers disposed between the low-frequency drivers and the rear wall of the housing; and a manifold disposed within the housing, the manifold comprising multiple acoustic passages for radiating acoustic outputs from the high-frequency drivers out of the housing.

21. The speaker of claim 20, wherein a target value of the cavity resonance frequency is higher than a cut-off frequency associated with a passband for the corresponding driver.

22. The acoustic transducer of claim 2, wherein the target value of the cavity resonance frequency is higher than a cut-off frequency associated with a passband for the driver.

* * * * *